US006802594B2

(12) United States Patent
Silverbrook

(10) Patent No.: US 6,802,594 B2
(45) Date of Patent: Oct. 12, 2004

(54) SYSTEM FOR ALIGNING A PLURALITY OF PRINTHEAD MODULES

(75) Inventor: Kia Silverbrook, Balmain (AU)

(73) Assignee: Silverbrook Research Pty Ltd, Balmain (AU)

( * ) Notice: Subject to any disclaimer, the term of this patent is extended or adjusted under 35 U.S.C. 154(b) by 0 days.

(21) Appl. No.: 10/636,271

(22) Filed: Aug. 8, 2003

(65) Prior Publication Data

US 2004/0032457 A1 Feb. 19, 2004

Related U.S. Application Data

(63) Continuation of application No. 10/129,437, filed as application No. PCT/AU01/00260 on Mar. 9, 2001.

(30) Foreign Application Priority Data

Mar. 9, 2000 (AU) ..... PQ6111

(51) Int. Cl.[7] ..... B41J 2/14
(52) U.S. Cl. ..... 347/49
(58) Field of Search ..... 347/20, 40, 42, 347/49; 29/890.1; 257/797

(56) References Cited

U.S. PATENT DOCUMENTS 5,734,394 A * 3/1998 Hackleman ..... 347/42

* cited by examiner

*Primary Examiner*—Thinh Nguyen
*Assistant Examiner*—Julian D. Huffman

(57) ABSTRACT

In a printing system, printhead modules with fiducials are used to misalign mounting of the modules to a support beam by a distance calculated from:

the difference in coefficient of thermal expansion between the support beam and the modules;

the spacing of the modules along the beam; and the difference between production temperature and operating temperature.

The beam is composed of a silicon core, an outer metal shell and an elastomeric layer therebetween.

The system ensures alignment of the modules at the operating temperature.

5 Claims, 1 Drawing Sheet

SYSTEM FOR ALIGNING A PLURALITY OF PRINTHEAD MODULES

Continuation Application of U.S. Ser. No. 10/129,437 filed on May 6, 2002 which is a 371 of PCT/AV01/00260 filed Mar. 6, 2001.

FIELD OF THE INVENTION

The present invention relates to printers, and in particular to digital inkjet printers.

Co-Pending Applications.

Various methods, systems and apparatus relating to the present invention are disclosed in the following co-pending applications filed by the applicant or assignee of the present invention on 24 May 2000:

PCT/AU00/00578 PCT/AU00/00579 PCT/AU00/00581 PCT/AU00/00580

PCT/AU00/00582 PCT/AU00/00587 PCT/AU00/00588 PCT/AU00/00589

PCT/AU00/00583 PCT/AU00/00593 PCT/AU00/00590 PCT/AU00/00591

PCT/AU00/00592 PCT/AU00/00584 PCT/AU00/00585 PCT/AU00/00586

PCT/AU00/00594 PCT/AU00/00595 PCT/AU00100596 PCT/AU00/00597

PCT/AU00/00598 PCT/AU00/00516 PCT/AU00/00517 PCT/AU00/00511

Various methods, systems and apparatus relating to the present invention are disclosed in the following co-pending application, PCT/AU00/01445, filed by the applicant or assignee of the present invention on 27 Nov. 2000. The disclosures of these co-pending applications are incorporated herein by cross-reference. Also incorporated by cross-reference are the disclosures of two co-filed PCT applications, PCT/AU01/00261 and PCT/AU01/00259 (deriving priority from Australian Provisional Patent Application No. PQ6110 and PQ6158). Further incorporated are the disclosures of two co-pending PCT applications filed 6 Mar. 2001, application numbers PCT/AU01/00238 and PCT/AU01/00239, which derive their priority from Australian Provisional Patent Application nos. PQ6059 and PQ6058.

BACKGROUND OF THE INVENTION

Recently, inkjet printers have been developed which use printheads manufactured by micro-electro mechanical systems (MEMS) techniques. Such printheads have arrays of microscopic ink ejector nozzles formed in a silicon chip using MEMS manufacturing techniques. The invention will be described with particular reference to silicon printhead chips for digital inkjet printers wherein the nozzles, chambers and actuators of the chip are formed using MEMS techniques. However, it will be appreciated that this is in no way restrictive and the invention may also be used in many other applications.

Silicon printhead chips are well suited for use in page-width printers having stationary printheads. These printhead chips extend the width of a page instead of traversing back and forth across the page, thereby increasing printing speeds. The probability of a production defect in an eight inch long chip is much higher than a one inch chip. The high defect rate translates into relatively high production and operating costs.

To reduce the production and operating costs of page-width printers, the printhead may be made up of a series of separate printhead modules mounted adjacent one another, each module having its own printhead chip. To ensure that there are no gaps or overlaps in the printing produced by adjacent printhead modules it is necessary to accurately align the modules after they have been mounted to a support beam. Once aligned, the printing from each module precisely abuts the printing from adjacent modules.

Unfortunately, the alignment of the printhead modules at ambient temperature will change when the support beam expands as it heats up to the temperature it maintains during operation.

SUMMARY OF THE INVENTION

Accordingly, the present invention provides a system for aligning two or more printhead modules mounted to a support member in a printer, the system including:

positioning the printhead modules on the support member such that they align when the support member is at its operating temperature but not necessarily at other temperatures.

Preferably, the support member is a beam and the printhead modules include MEMS manufactured chips having at least one fiducial on each;

wherein, the fiducials are used to misalign the printhead modules by a distance calculated from:

i) the difference between the coefficient of thermal expansion of the beam and the printhead chips;

ii) the spacing of the printhead chips along the beam; and, iii) the difference between the production temperature and the operating temperature.

Conveniently, the beam may have a core of silicon and an outer metal shell. In a further preferred embodiment, the beam is adapted to allow limited relative movement between the silicon core and the metal shell. To achieve this, the beam may include an elastomeric layer interposed between the silicon core and metal shell. In other forms, the outer shell may be formed from laminated layers of at least two different metals.

It will be appreciated that this system requires the coefficient of thermal expansion of the printhead chips to be greater than or equal to the coefficient of thermal expansion of the beam, otherwise the "gaps" left between the printhead modules as compensation at ambient temperature will not close as the beam reaches the operating temperature.

BRIEF DESCRIPTION OF THE DRAWING

A preferred embodiment of the invention will now be described, by way of example only, with reference to the accompanying drawing in which.

DETAILED DESCRIPTION OF PREFERRED EMBODIMENTS

Figure 1:
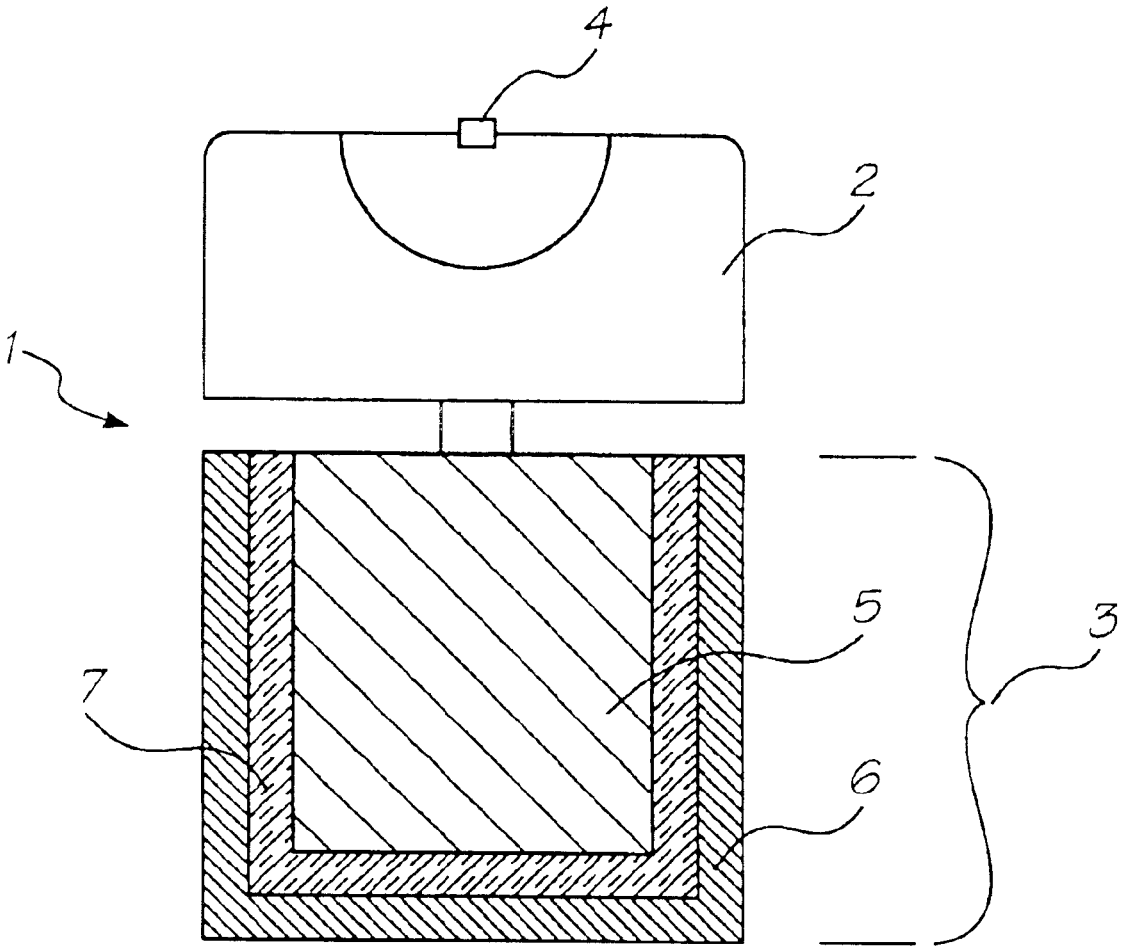
FIG. 1 shows a schematic cross section of a printhead assembly according to the present invention.

Referring to the figure the printhead assembly 1 has a plurality of printhead modules 2 mounted to a support member 3 in a printer (not shown). The printhead module includes a silicon printhead chip 4 in which the nozzles, chambers, and actuators are manufactured using MEMS techniques. Each printhead chip 4 has at least 1 fiducial (not shown) for aligning the printheads. Fiducials are reference markings placed on silicon chips and the like so that they may be accurately positioned using a microscope.

According to one embodiment of the invention, the printheads are aligned while the printer is operational and the assembly is at the printing temperature. If it is not possible to view the fiducial marks while the printer is operating, an alternative system of alignment is to misalign the printhead modules on the support beam 3 such that when the printhead assembly heats up to the operating temperature, the printheads move into alignment. This is easily achieved by adjusting the microscope by the set amount of misalignment required or simply misaligning the printhead modules by the required amount.

The required amount is calculated using the difference between the coefficients of thermal expansion of the printhead modules and the support beam, the length of each individual printhead module and the difference between ambient temperature and the operating temperature. The printer is designed to operate with acceptable module alignment within a temperature range that will encompass the vast majority of environments in which it expected to work. A typical temperature range may be 0° C. to 40° C. During operation, the operating temperature of the printhead rise a fixed amount above the ambient temperature in which the printer is operating at the time. Say this increase is 50° C, the temperature range in which the alignment of the modules must be within the acceptable limits is 50° C. to 90° C. Therefore, when misaligning the modules during production of the printhead, the production temperature should be carefully maintained at 20° C. to ensure that the alignment is within acceptable limits for the entire range of predetermined ambient temperatures (i.e. 0° C. to 40° C.).

To minimize the difference in coefficient of thermal expansion between the printhead modules and the support beam 3, the support beam has a silicon core 5 mounted within a metal channel 6. The metal channel 6 provides a strong cost effective structure for mounting within a printer while the silicon core provides the mounting points for the printhead modules and also helps to reduce the coefficient of thermal expansion of the support beam 3 as a whole. To further isolate the silicon core from the high coefficient of thermal expansion in the metal channel 6 an elastomeric layer 7 is positioned between the core 5 and the channel 6. The elastomeric layer 7 allows limited movement between the metal channel 6 and the silicon core 5. The invention has been described with reference to specific embodiments. The ordinary worker in this field readily recognise that the invention may be embodied in many other forms.

what is claimed is:

1. A system for aligning a plurality of printhead modules mounted on a support member in a printer wherein the support member is a beam and the printhead modules include MEMS manufactured chips having at least one fiducial on each;

wherein, the fiducials are used to misalign the printhead modules at ambient temperature by a distance calculated from:

i) the difference in coefficient thermal expansion between the beam and the printhead chips;

ii) the spacing of the printhead chips along the beam; and, iii) the difference between the production temperature and the operating temperature.

2. A system for aligning a plurality of printhead modules mounted to a support member and a printer according to claim 1 wherein the beam has a core of silicon and an outer metal shell.

3. A system for aligning a plurality of printhead modules mounted to a support member in a printer according to claim 2 wherein the beam is adapted to allow limited relative movement between the silicon core and the metal shell.

4. A system for aligning a plurality of printhead modules mounted to a support member in a printer according to claim 3 wherein the beam has an elastomeric layer between the silicon core and metal shell to permit the limited relative movement.

5. A system for aligning a plurality of printhead modules mounted to a support member in a printer according to claim 4 wherein the outer shell is formed from laminated layers of at least two different metals.

* * * * *